US008142259B2

(12) United States Patent
Arai

(10) Patent No.: US 8,142,259 B2
(45) Date of Patent: Mar. 27, 2012

(54) GRINDING MACHINE AND METHOD

(75) Inventor: Kazuhisa Arai, Ota-Ku (JP)

(73) Assignee: Disco Corporation, Tokyo (JP)

( * ) Notice: Subject to any disclaimer, the term of this patent is extended or adjusted under 35 U.S.C. 154(b) by 445 days.

(21) Appl. No.: 12/422,674

(22) Filed: Apr. 13, 2009

(65) Prior Publication Data

US 2009/0280722 A1 Nov. 12, 2009

(30) Foreign Application Priority Data

May 8, 2008 (JP) ..... 2008-122030

(51) Int. Cl.
*B24B 1/00* (2006.01)
*B24B 7/07* (2006.01)

(52) U.S. Cl. ..... 451/37; 451/65

(58) Field of Classification Search ..... 451/36, 451/37, 57, 60, 65, 446, 526–528, 164
See application file for complete search history.

(56) References Cited

U.S. PATENT DOCUMENTS 2,309,819 A * 2/1943 Benner ..... 451/446
6,332,832 B1 * 12/2001 Suzuki ..... 451/527
6,386,956 B1 * 5/2002 Sato et al. ..... 451/57
6,656,020 B2 * 12/2003 Nobe ..... 451/60
6,905,398 B2 * 6/2005 Jeong ..... 451/57
2005/0107016 A1 * 5/2005 Hoshino ..... 451/287

FOREIGN PATENT DOCUMENTS

JP A 2002-319559 10/2002

* cited by examiner

*Primary Examiner* — Hadi Shakeri

(74) *Attorney, Agent, or Firm* — Greer, Burns & Crain, Ltd.

(57) ABSTRACT

A grinding machine includes a holding table adapted to hold a workpiece, a grinding unit operative to grind the workpiece held on the holding piece, and a grinding unit transfer mechanism operative to shift the grinding unit in a direction coming close to or moving away from the workpiece. The grinding unit includes a porous pad having fine pores opposed to the workpiece, a gel-like slurry storing portion provided on the porous pad so as to store a gel-like slurry therein, and a water supply unit to supply water between the porous pad and the workpiece. The porous pad contains relatively larger superabrasives at least at an outer circumferential portion. The fine pores of the porous pad have a diameter greater than that of relatively small superabrasives contained in the gel-like slurry.

2 Claims, 5 Drawing Sheets

GRINDING MACHINE AND METHOD

BACKGROUND OF THE INVENTION

1. Field of the Invention

The present invention relates to a grinding machine for grinding a workpiece such as a semiconductor wafer, a glass substrate, a ceramic substrate, etc. and a grinding method using the grinding machine.

2. Description of the Related Art

A semiconductor wafer, a glass substrate, a sapphire substrate, or a ceramic substrate such as SiC on which a plurality of devices such as ICs, LSIs or the like are formed is ground from a rear surface to a predetermined thickness. Thereafter, it is divided by a cutting machine such as a dicing machine or laser dicing machine into individual pieces, which are used in electronic devices such as cell phones, personal computers, etc. In general, a grinding wheel containing superabrasives such as diamond grindstones are widely used to grind the semiconductor wafer or the like. However, since the grinding by the grinding wheel is executed through fine brittle fracture, there arises a problem in that a ground surface causes a plurality of fine strains, which lowers bending strength of the workpiece.

To eliminate the problem, the ground surfaced of the workpiece after rough grinding is finish-ground and the finish-ground workpiece is subjected to finish processing such as polishing or etching to remove the strains generated by the grinding. As the finish grinding for a workpiece, a method is proposed for allowing gel-like slurry to flow out from fine pores of a porous pad and finish grinding the workpiece with superabrasives contained in the gel-like slurry. Incidentally, the gel-like slurry is a mixture of glue and superabrasives. If the porous pad gets wet, the gel-like slurry flows out from the porous pad to the upper surface of the workpiece. Thus, the workpiece is finish-ground with the superabrasives contained in the gel-like slurry.

A grinding machine combining the porous pad with gel-like slurry is effective in finish-grinding a workpiece. However, another grinding device is needed to rough-grind the workpiece with a rotatably driven grinding wheel. This is less preferable in view of economic efficiency.

SUMMARY OF THE INVENTION

Accordingly, it is an object of the present invention to provide a compact grinding machine that can alone perform rough grinding and finish grinding.

In accordance with an aspect of the present invention, there is provided a grinding machine including: a holding table adapted to hold a workpiece; grinding means for grinding the workpiece held on the holding table; and a grinding means transfer mechanism operative to move the grinding means in a direction coming close to or moving away from the workpiece; wherein the grinding means includes, a porous pad having a large number of fine pores opposed to the workpiece held on the holding table, a gel-like slurry storing portion provided on the porous pad so as to store gel-like slurry therein, and water supply means for supplying water between the porous pad and the workpiece; and the porous pad contains superabrasives at least at an outer circumferential portion, and the fine pores of the porous pad each have a diameter greater than that of each of the superabrasives contained in the gel-like slurry.

In accordance with another aspect of the present invention, there is provided a grinding method for grinding a workpiece using the above-mentioned grinding machine, including the steps of: grinding-transferring, by use of the grinding means transfer means, the porous pad in a direction towards the workpiece held on the holding table, and pressing the porous pad against the workpiece for performing rough grinding on the workpiece; and then, reducing pressing force of the porous pad against the workpiece and performing finish grinding on the workpiece with the gel-like slurry flowing out from the porous pad.

According to the present invention, the grinding means transfer mechanism grinding-transfers the porous pad and presses against the workpiece at a given pressure and the porous pad containing superabrasives is made to function as a grinding wheel for rough grinding. Thereafter, the pressing force is reduced to allow the gel-like slurry to flow out from the porous pad. The finish grinding of the workpiece can be performed with the superabrasives contained in the gel-like slurry. Thus, the grinding machine of the present invention can achieve both the rough grinding and finish grinding by means of the single grinding means without the necessity of a rough grinding portion and a finish grinding portion separate from each other.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
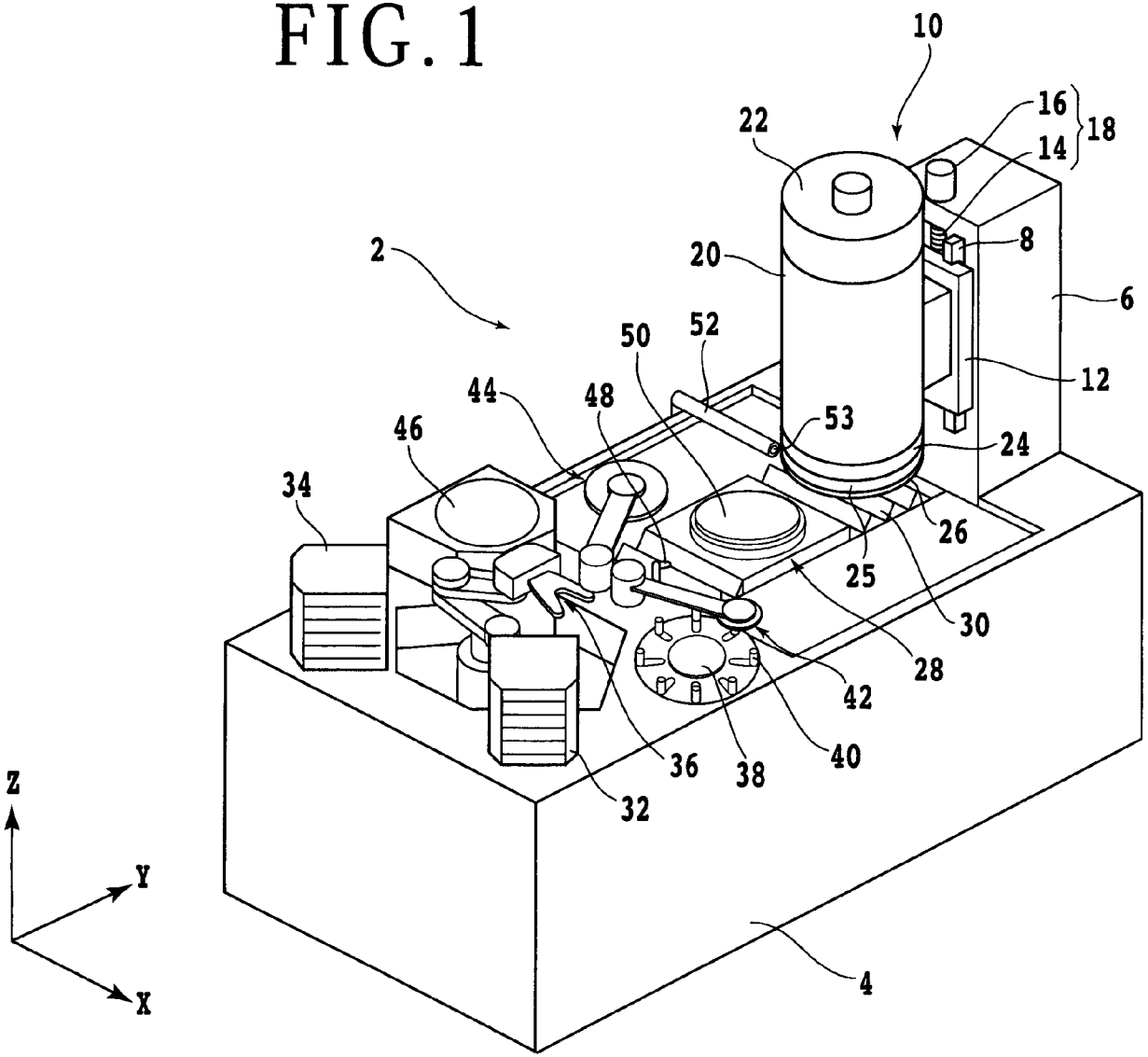
FIG. 1 is an exterior perspective view of a grinding machine according to an embodiment of the present invention.

Preferred embodiments of the present invention will hereinafter be described in detail with reference to the drawings. FIG. 1 is a perspective view of a grinding machine 2 according to an embodiment of the present invention. Reference numeral 4 denotes a housing of the grinding machine 2. A column 6 is provided at a rear portion of the housing 4 so as to extend upright. A pair of guide rails 8 are secured to the column 6 so as to extend upward and downward. (Only one of the guide rails 8 is illustrated.) A grinding unit (grinding means) 10 is mounted along the guide rails 8 so as to be shiftable upward and downward. The grinding unit 10 is such that its housing 20 is attached to a shifting base 12 which is shifted upward and downward along the pair of guide rails 8.

The grinding unit 10 includes the housing 20; a spindle, not shown, rotatably housed in the housing 20; a servo motor 22 adapted to rotatably drive the spindle; a mount 24 secured to the leading end of the spindle; a gel-like slurry storing portion 25 attached to the mount 24; and a porous pad 26 disposed on the bottom of the gel-like slurry storing portion 25. The grinding unit 10 includes a grinding unit shifting mechanism 18 composed of a ball screw 14 adapted to shift the grinding unit 10 upward and downward along the guide rails 8 and a pulse motor 16. The pulse motor 16 is pulse-driven to rotate the ball screw 14 to shift the shifting base 12 upward and downward.

A holding table mechanism 28 having a holding table 50 is disposed at an intermediate portion of the housing 4. The holding table mechanism 28 is shifted in a Y-axial direction by a holding table shifting mechanism not illustrated. Reference numeral 30 denotes a bellows covering the holding table mechanism 28. A first wafer cassette 32, a second wafer cassette 34, a wafer-conveying robot 36, a positioning mechanism 38 having a plurality of positioning pins 40, a wafer carrying-in mechanism (loading arm) 42, a wafer carrying-out mechanism (unloading arm) 44 and a spinner unit 46 are arranged at a front portion of the housing 4.

A cleaning water jet nozzle 48 used to clean the holding table mechanism 28 is provided at a generally central portion of the housing 4. In the state where the holding table mechanism 28 is positioned at a wafer-carrying-in and out area in front of the unit, the cleaning water jet nozzle 48 jets cleaning water toward the holding table mechanism 28. Reference numeral 52 denotes a grinding water supply nozzle, which is adapted to jet water from a water jet port 53 located at its tip toward between the porous pad 26 and the wafer held on the holding table 50.

Figure 2A:
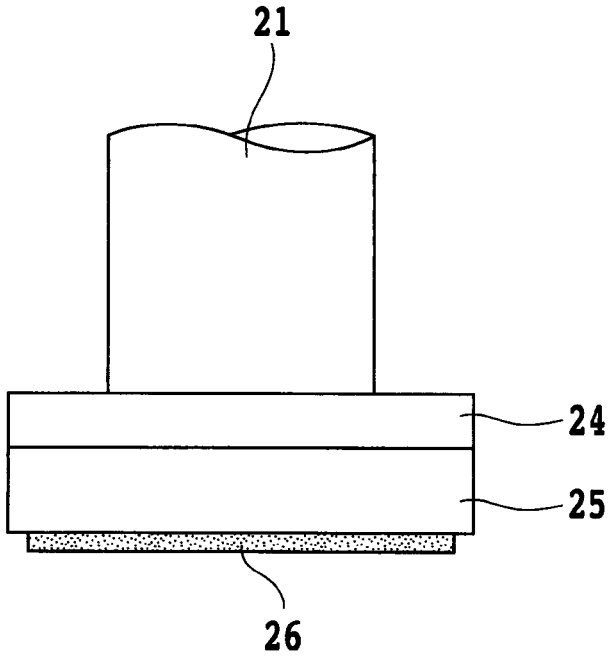
FIGS. 2A and 2B illustrate an attachment structure of a porous pad.
Figure 2B:
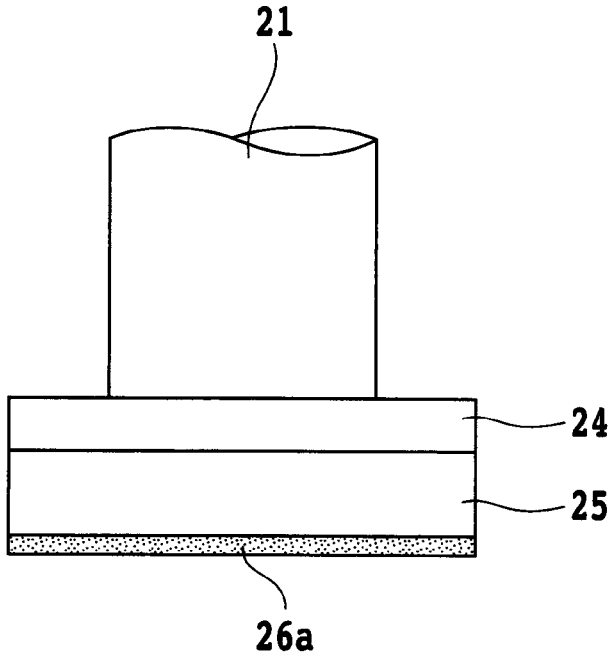

Referring to FIG. 2A, the mount 24 is secured to the leading end of the spindle 21 and the gel-like slurry storing portion 25 is attached to the mount 24. The porous pad 26 is attached to the bottom of the gel-like slurry storing portion 25. FIG. 2B illustrates another embodiment of a porous pad attachment structure, in which a porous pad 26*a* is attached to the bottom of a gel-like slurry storing portion 25 so as to block the bottom part thereof.

Figure 3A:
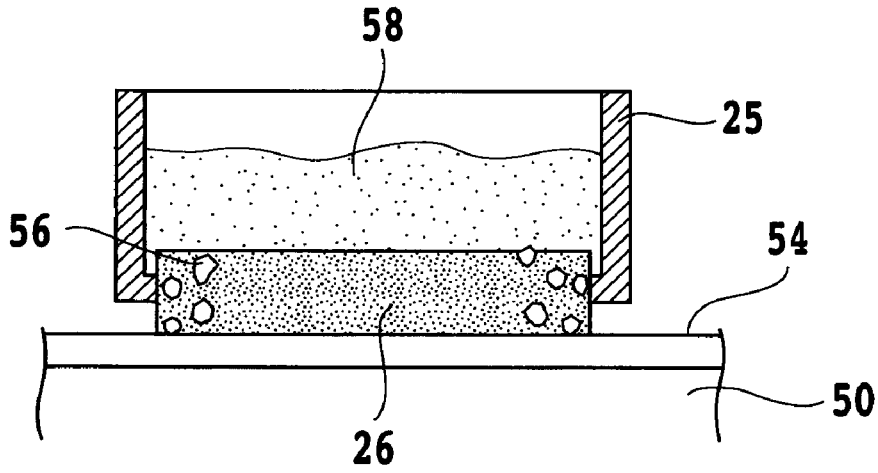
FIG. 3A is a cross-sectional view illustrating a state of rough grinding.

FIG. 3A is a cross-sectional view illustrating a state where a wafer 54 held on the holding table 50 is rough-ground. Superabrasives 56 including diamond abrasive grains, CBN (cubic boron nitride) abrasive grains, or other abrasive grains are dispersed and arranged at the outer circumferential portion of the porous pad 26. Gel-like slurry 58 including a mixture of glue material and fine superabrasives is stored in the gel-like slurry storing portion 25. To rough-grind the wafer 54, the wafer 54 is rotated in a given direction by the holding table 50. Along with this, while the spindle 21 is rotated in the same direction as the wafer 54, the grinding unit shifting mechanism 18 is driven to lower the porous pad 26 and press it against the wafer 54 on the holding table 50. Thus, the rough grinding of the wafer 54 is performed while jetting grinding water from the grinding water supply nozzle 52.

Figure 3B:
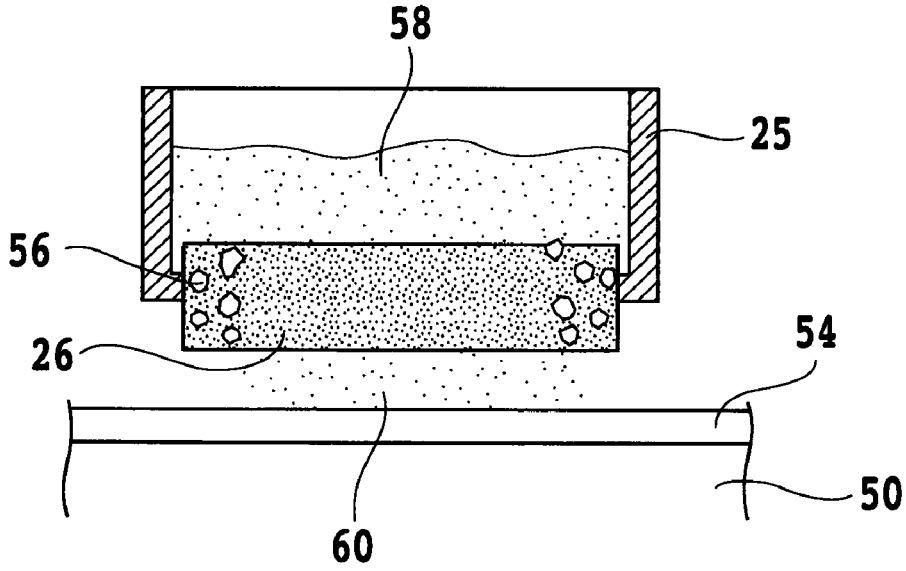
FIG. 3B is a cross-sectional view illustrating a state where the porous pad is lifted.

In this case, the porous pad 26 is pressed against the upper surface of the wafer 54 at a given pressure so that the superabrasives 56 in the porous pad 26 are exposed from the lower surface of the porous pad 26. Thus, the rough grinding of the wafer 54 is performed by the exposed superabrasives 56. After the rough grinding of the wafer 54 has been completed, the grinding unit shifting mechanism 18 is driven to slightly lift the porous pad 26 as illustrated in FIG. 3B. Since grinding water is supplied to the porous pad 26 from the grinding water supply nozzle 52, the gel-like slurry 58 containing fine abrasive grains 60 flows out to the upper surface of the wafer 54 via fine pores of the porous pad 26.

If the pressing force against the porous pad 26 is released or the pressing force against the wafer 54 is small, the expansion of the porous pad 26 allows the superabrasives 56 not to almost go out from the front surface of the porous pad 26 but to be stored therein. Thus, if the grinding unit shifting mechanism 18 is driven to press the porous pad 26 against the wafer 54 at low pressure, the finish grinding of the wafer 54 can be performed by the fine superabrasives in the gel-like slurry 58 flowing out via the fine pores of the porous pad 26.

Incidentally, FIG. 3B illustrates the state where the porous pad 26 is spaced apart from the wafer 54 in order to show the fine superabrasives 60 flowing out via the fine pores of the porous pad 26. However, in practice, the pressing force against the porous pad 26 is reduced from the state of the rough grinding shown in FIG. 3A to withdraw the superabrasives 56 inwardly of the porous pad 26. Subsequently to the rough grinding, finish grinding can be performed with the fine superabrasives 60 in the gel-like slurry 58 flowing out via the fine pores of the porous pad 26.

Figure 4A:
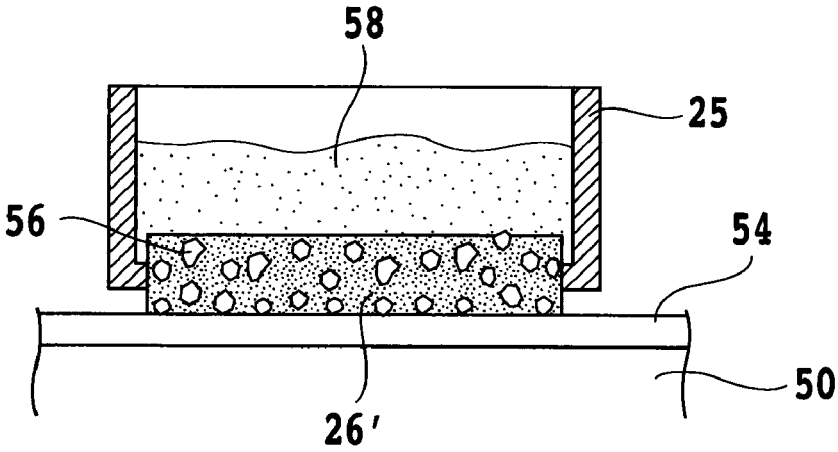
FIG. 4A is a cross-sectional view illustrating a porous pad encountered during rough grinding according to another embodiment.
Figure 4B:
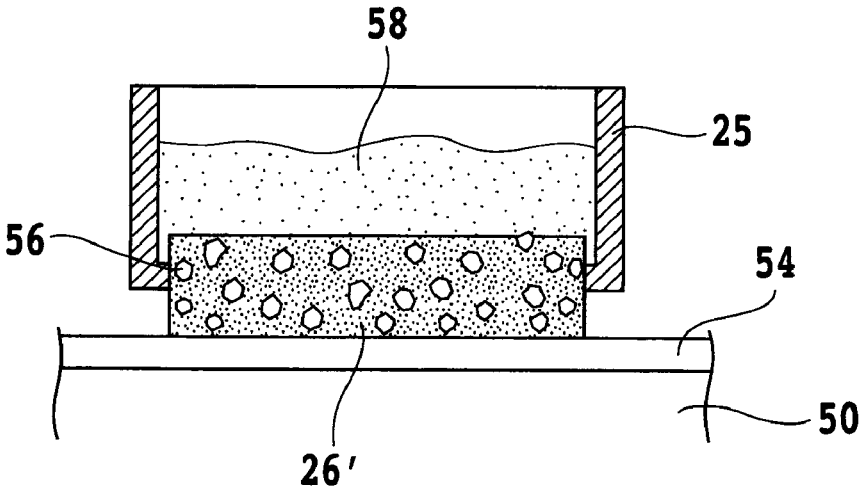
FIG. 4B is a cross-sectional view illustrating the porous pad encountered during finish grinding according to the another embodiment.

Referring to FIGS. 4A and 4B, another embodiment of a porous pad 26' is illustrated in which superabrasives 56 are dispersed and arranged in the entire area thereof. FIG. 4A is a cross-sectional view illustrating a state during rough grinding and FIG. 4B is a cross-sectional view illustrating a state during finish grinding. During the rough grinding illustrated in FIG. 4A, the porous pad 26' is pressed against a wafer 54 at a given pressing force to expose the superabrasives 56 in the porous pad 26' to the lower surface of the porous pad 26'. The rough grinding can be performed on the wafer 54 with the exposed superabrasives 56. On the other hand, during the finish grinding of the wafer 54, the pressing force of the porous pad 26' against the wafer 54 is reduced to withdraw the superabrasives 56 inward of the porous pad 26' as illustrated in FIG. 4B. Thus, the finish grinding can be performed on the wafer 54 with the fine superabrasives 60 in the gel-like slurry 58 flowing out to the upper surface of the wafer 54 via the fine pores of the porous pad 26'.

Figure 5A:
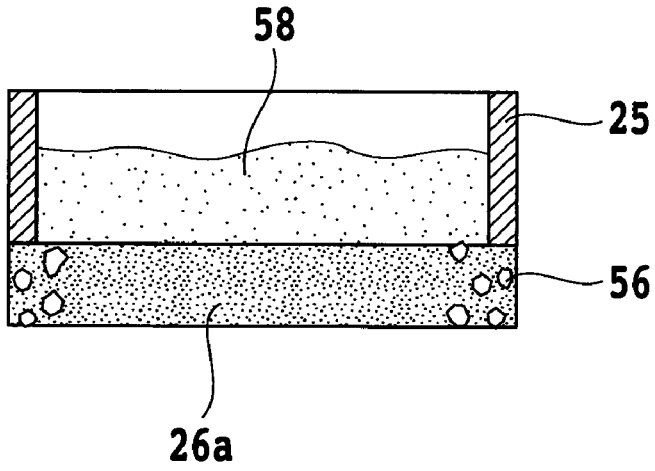
FIG. 5A is a cross-sectional view illustrating a porous pad encountered during rough grinding according to further another embodiment.
Figure 5B:
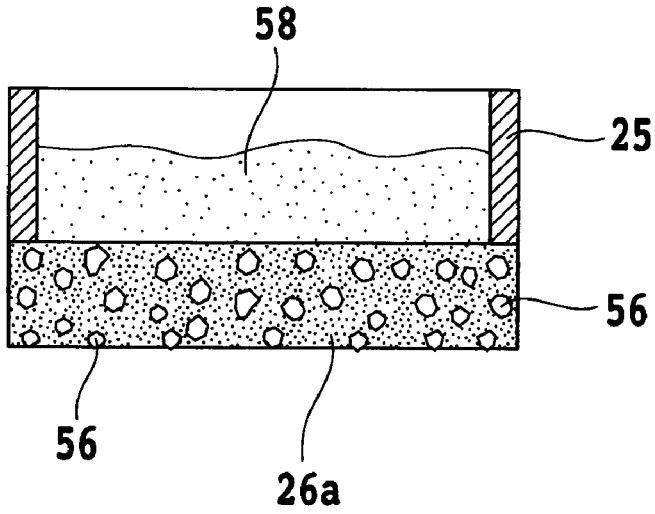
FIG. 5B is a cross-sectional view illustrating the porous pad encountered during finish grinding according to the further another embodiment.

Referring to FIGS. 5A and 5B, a porous pad 26*a* according to another embodiment of the present invention is illustrated. The porous pad 26*a* is attached to a porous pad storing portion 25 so as to block the bottom thereof. FIG. 5A illustrates a state of the porous pad 26*a* encountered during rough grinding and FIG. 5B illustrates a state of the porous pad 26*a* encountered during finish grinding.

Also in the case of the porous pad 26*a* of the embodiment, operation encountered during grinding is the same as that of the embodiment described above. The gel-like slurry 58 may be supplied on the wafer 54 also during the rough grinding. Alternatively, the gel-like slurry 58 may not be supplied during the rough grinding but may supplied to the upper surface of the wafer also during the finish grinding.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A grinding machine comprising:

a holding table adapted to hold a workpiece;

a grinding unit for grinding the workpiece held on the holding table; and a grinding unit transfer mechanism operative to move the grinding unit in a direction coming close to or moving away from the workpiece;

wherein the grinding unit includes, a porous pad having a large number of fine pores opposed to the workpiece held on the holding table, a gel-like slurry storing portion provided on the porous pad storing gel-like slurry therein, and a water supply unit for supplying water between the porous pad and the workpiece;

wherein the porous pad contains first superabrasives at least at an outer circumferential portion to rough grind the workpiece, wherein the gel-like slurry contains second superabrasives therein, and wherein the fine pores of the porous pad have a diameter greater than that of the second superabrasives contained in the gel-like slurry, such that the gel-like slurry with the second superabrasives therein passes through the porous pad to finish grind the workpiece.

2. A grinding method for grinding a workpiece comprising the steps of:

providing a grinding machine having:

a holding table adapted to hold a workpiece;

a grinding unit for grinding the workpiece held on the holding table; and a grinding unit transfer mechanism operative to move the grinding unit in a direction coming close to or moving away from the workpiece wherein the grinding unit includes, a porous pad having a large number of fine pores opposed to the workpiece held on the holding table, a gel-like slurry storing portion provided on the porous pad storing gel-like slurry therein, and a water supply unit for supplying water between the porous pad and the workpiece;

wherein the porous pad contains first superabrasives at least at an outer circumferential portion, wherein the gel-like slurry contains second superabrasives therein, and the fine pores of the porous pad have a diameter greater than that of second superabrasives contained in the gel-like slurry;

grinding-transferring, by use of the grinding unit transfer mechanism, the porous pad in a direction towards the workpiece held on the holding table, pressing the porous pad against the workpiece for performing rough grinding on the workpiece; and reducing pressing force of the porous pad against the workpiece and performing finish grinding on the workpiece with the gel-like slurry flowing out from the porous pad.

* * * * *